US011441428B2

(12) United States Patent
Senoo et al.

(10) Patent No.: US 11,441,428 B2
(45) Date of Patent: Sep. 13, 2022

(54) TURBINE BLADE AND STEAM TURBINE INCLUDING THE SAME

(71) Applicant: MITSUBISHI POWER, LTD., Yokohama (JP)

(72) Inventors: Shigeki Senoo, Tokyo (JP); Kazuhiro Momma, Yokohama (JP); Reza Abhari, Zurich (CH); Anestis Kalfas, Zurich (CH); Ilias Papagiannis, Zurich (CH); Vahid Iranidokht, Zurich (CH)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 17/312,277

(22) PCT Filed: Oct. 21, 2019

(86) PCT No.: PCT/JP2019/041261
§ 371 (c)(1),
(2) Date: Jun. 9, 2021

(87) PCT Pub. No.: WO2020/129390
PCT Pub. Date: Jun. 25, 2020

(65) Prior Publication Data

US 2022/0106883 A1 Apr. 7, 2022

(30) Foreign Application Priority Data

Dec. 18, 2018 (JP) ..... JP2018-236007

(51) Int. Cl.
*F01D 5/14* (2006.01)
*F01D 9/02* (2006.01)

(52) U.S. Cl.
CPC ..... *F01D 5/143* (2013.01); *F01D 5/145* (2013.01); *F01D 9/02* (2013.01); *F05D 2220/31* (2013.01); *F05D 2240/301* (2013.01)

(58) Field of Classification Search
CPC ..... F01D 5/143; F01D 5/145
See application file for complete search history.

(56) References Cited

U.S. PATENT DOCUMENTS 7,220,100 B2 * 5/2007 Lee ..... F01D 5/143 416/193 A
8,511,978 B2 * 8/2013 Allen-Bradley ..... F01D 5/145 416/193 A (Continued)

FOREIGN PATENT DOCUMENTS

DE 102008021053 A1 * 10/2009 ..... F01D 5/143
DE 102008021053 A1 10/2009

(Continued)

OTHER PUBLICATIONS

International Search Report dated Dec. 17, 2019, issued in counterpart Application No. PCT/JP2019/041261. (10 pages).

(Continued)

*Primary Examiner* — Sabbir Hasan
(74) *Attorney, Agent, or Firm* — WHDA, LLP

(57) ABSTRACT

A turbine blade includes an airfoil portion having a pressure surface and a suction surface each of which extends between a leading edge and a trailing edge, and a platform including an end wall to which a base-end portion of the airfoil portion is connected. The end wall includes a concave portion on suction surface disposed at least in a region of suction surface of the end wall, and a convex portion on pressure surface disposed at least in a region of pressure surface of the end wall. The concave portion on suction surface has a bottom point located on an axially upstream side of a tangent point on the suction surface, the suction surface having a tangential line extending in an axial direction through the tangent point.

14 Claims, 8 Drawing Sheets

(56) References Cited

U.S. PATENT DOCUMENTS

| | | | | |
|---|---|---|---|---|
| 10,190,417 | B2 * | 1/2019 | Brozyna | F01D 5/147 |
| 2006/0233641 | A1 | 10/2006 | Lee et al. | |
| 2010/0143139 | A1 | 6/2010 | Pandey et al. | |
| 2013/0224027 | A1 | 8/2013 | Barr et al. | |
| 2017/0226863 | A1 | 8/2017 | Brozyna et al. | |
| 2021/0189883 | A1 | 6/2021 | Koda | |

FOREIGN PATENT DOCUMENTS

| | | | |
|---|---|---|---|
| EP | 0654585 | A1 | 5/1995 |
| JP | 2000-104501 | A | 4/2000 |
| JP | 2006-291949 | A | 10/2006 |
| JP | 2012-511653 | A | 5/2012 |
| JP | 5490178 | B2 | 5/2014 |
| SE | 609299 | C2 | 1/1999 |
| WO | 2018/029770 | A1 | 2/2018 |

OTHER PUBLICATIONS

Notification of Transmittal of Translation of the International Preliminary Report on Patentability (Form PCT/IB/338) issued in counterpart International Application No. PCT/JP2019/041261 dated Jul. 1, 2021 with Forms PCT/IB/373 and PCT/ISA/237. (18 pages).
Office Action dated Sep. 22, 2021, issued in counterpart IN Application No. 202127026186, with English translation. (8 pages).

* cited by examiner

TURBINE BLADE AND STEAM TURBINE INCLUDING THE SAME

TECHNICAL FIELD

The present disclosure relates to a turbine blade and a steam turbine including the same.

BACKGROUND

In a turbine such as a steam turbine or a gas turbine, a loss may be caused by a fluid flow in a blade row. Thus, it is proposed that a concave portion and a convex portion are disposed in an end wall (side wall) of a platform to which an airfoil portion of a turbine blade is connected, thereby suppressing the fluid loss in the turbine.

For example, Patent Document 1 discloses a turbine blade which includes a concave portion (passagethrough) disposed in the vicinity of a convex portion on suction surface and a convex portion (bump) disposed in the vicinity of a leading edge on a pressure surface of an airfoil portion, in a region of suction surface of the airfoil portion of an end wall of a platform.

CITATION LIST

Patent Literature

Patent Document 1: US Patent Application Publication No. 2017/0226863

SUMMARY

Technical Problem

In general, a static pressure tends to be low in the vicinity of a convex portion on a suction surface in operation of a turbine, and thus it is considered that disposing the concave portion in the vicinity of the convex portion on the suction surface in the vicinity of the end wall of the platform, it is possible to increase the static pressure in the above-described portion to reduce a blade loading.

Meanwhile, a leakage flow from the upstream side of a turbine blade may flow into the turbine blade in accordance with, for example, the type of turbine. In this case, a loss owing to the above-described leakage flow may be caused.

Conventionally, however, an end wall shape for reducing such loss owing to the leakage flow has not been proposed, and Patent Document 1 does not mention the end wall shape for reducing the loss owing to the leakage flow, either.

In view of the above, an object of at least one embodiment of the present invention is to provide a turbine blade capable of reducing a loss which may be caused by a leakage flow, and a steam turbine including the same.

Solution to Problem (1) A turbine blade according to at least some embodiments of the present invention includes an airfoil portion having a pressure surface and a suction surface each of which extends between a leading edge and a trailing edge, and a platform including an end wall to which a base-end portion of the airfoil portion is connected. The end wall includes a concave portion on suction surface disposed at least in a region of suction surface of the end wall, and a convex portion on pressure surface disposed at least in a region of pressure surface of the end wall. The concave portion on suction surface has a bottom point located on an axially upstream side of a tangent point on the suction surface, the suction surface having a tangential line extending in an axial direction through the tangent point. The end wall has at least one contour line on the concave portion on suction surface, the at least one contour line having a normal line on an intersection point between the at least one contour line and the suction surface such that a normal vector having a negative gradient along the normal line is directed toward the airfoil portion. The convex portion on pressure surface has a peak point located on an axially downstream side of the tangent point.

A leakage flow without a circumferential component may flow into the vicinity of the end wall of the turbine blade from the upstream side of the turbine blade. The leakage flow flows into the rotating turbine blade and then heads for the suction surface of the turbine blade, which may cause a collision (back hit) of the leakage flow against the suction surface, or due to an interaction between the leakage flow and a flow (main flow) including the circumferential component, may cause circumferential non-uniformity of a static pressure distribution.

In this regard, in the above configuration (1), the bottom point of the concave portion on suction surface is located on the axially upstream side of the above-described tangent point, and the above-described normal vector is directed toward the airfoil portion. That is, the bottom point of the concave portion on suction surface is located close to the suction surface on the axially upstream side of a position where the suction surface protrudes the most (a position of the above-described tangent point), and the concave portion on suction surface has an obliquity descending toward the suction surface in the vicinity of the suction surface. Thus, it is possible to increase the static pressure in the vicinity of the above-described position, making it possible to alleviate the circumferential non-uniformity of the static pressure distribution in the vicinity of the end wall in the axially upstream portion of the turbine blade, or to reduce the collision (back hit) of the leakage flow from the upstream side of the turbine blade against the suction surface. Thus, it is possible to reduce the circumferential non-uniformity of the static pressure distribution and a loss owing to the back hit of the leakage flow.

Moreover, in the above configuration (1), the peak point of the convex portion on pressure surface is located on the axially downstream side of the above-described tangent point. That is, the peak point of the convex portion on pressure surface is located on the axially downstream side of the bottom point of the concave portion on suction surface. Thus, it is possible to reduce the static pressure in the vicinity of the above-described position, making it possible to reduce a secondary flow from the pressure surface toward the suction surface of the adjacent turbine blade, and to prevent, for example, a leakage flow avoiding a collision against the suction surface by the above-described concave portion on suction surface from becoming the secondary flow in the vicinity of the pressure surface. Thus, it is possible to reduce a secondary flow loss in the turbine blade.

In view of the foregoing, with the above configuration (1), it is possible to effectively reduce the loss which may be caused by the leakage flow in the turbine.

(2) In some embodiments, in the above configuration (1), the convex portion on pressure surface has at least one contour line having a normal line on an intersection point between the at least one contour line and the pressure surface such that a normal vector having a positive gradient along the normal line is directed toward the airfoil portion.

With the above configuration (2), the above-described normal vector is directed toward the airfoil portion. That is, the peak point of the convex portion on pressure surface is located close to the pressure surface, and the convex portion on pressure surface has an obliquity ascending toward the pressure surface in the vicinity of the pressure surface. Thus, it is possible to reduce the static pressure in the vicinity of the above-described position, making to possible to effectively reduce the secondary flow in the turbine blade and to reduce the loss by the secondary flow more effectively.

(3) In some embodiments, in the above configuration (1) or (2), the convex portion on pressure surface expands along the pressure surface at least from a position of the peak point to a position of the bottom point of the concave portion on suction surface in the axial direction.

With the above configuration (3), since the convex portion on pressure surface extends along the pressure surface over a wide range at least from the position of the peak point of the convex portion on pressure surface to the position of the bottom point of the concave portion on suction surface in the axial direction, it is possible to reduce the static pressure over the wide range in the vicinity of the pressure surface. Thus, it is possible to effectively prevent the leakage flow avoiding the collision against the suction surface by the concave portion on suction surface from becoming the secondary flow in the vicinity of the pressure surface of the adjacent turbine blade. Thus, it is possible to effectively reduce the secondary flow loss in the turbine blade.

(4) In some embodiments, in any one of the above configurations (1) to (3), a ratio L1/L0 of an axial distance L1 between the bottom point of the concave portion on suction surface and the peak point of the convex portion on pressure surface to an axial length L0 of the airfoil portion on the end wall is at least 0.1 and at most 0.9.

With the above configuration (4), since the ratio L1/L0 of the distance L1 between the bottom point of the concave portion on suction surface and the peak point of the convex portion on pressure surface to the axial length L0 of the airfoil portion on the end wall is at least 0.1 and at most 0.9, the leakage flow avoiding the collision against the suction surface by the concave portion on suction surface is easily introduced to the vicinity of the convex portion on pressure surface. Thus, it is possible to effectively prevent the leakage flow from becoming the secondary flow in the vicinity of the pressure surface and to effectively reduce the secondary flow loss in the turbine blade.

(5) In some embodiments, in any one of the above configurations (1) to (4), an angle between an axial straight line, and a straight line that connects the bottom point of the concave portion on suction surface and the peak point of the convex portion on pressure surface of an adjacent turbine blade is not less than 10 degrees and not greater than 80 degrees.

With the above configuration (5), since the angle between the axial straight line, and the straight line that connects the bottom point of the concave portion on suction surface and the peak point of the convex portion on pressure surface of the adjacent turbine blade is not less than 10 degrees and not greater than 80 degrees, the leakage flow avoiding the collision against the suction surface by the concave portion on suction surface is easily introduced to the vicinity of the convex portion on pressure surface. Thus, it is possible to effectively prevent the leakage flow from becoming the secondary flow in the vicinity of the pressure surface and to effectively reduce the secondary flow loss in the turbine blade.

(6) In some embodiments, in any one of the above configurations (1) to (5), the convex portion on pressure surface extends along the pressure surface over not less than 90% of an axial length L0 of the airfoil portion on the end wall.

With the above configuration (6), since the convex portion on pressure surface extends along the pressure surface over not less than 90% of the axial length L0 of the airfoil portion on the end wall in the axial direction, it is possible to reduce the static pressure over the wide range in the vicinity of the pressure surface. Thus, it is possible to effectively prevent the leakage flow avoiding the collision against the suction surface by the concave portion on suction surface from becoming the secondary flow in the vicinity of the pressure surface of the adjacent turbine blade. Thus, it is possible to effectively reduce the secondary flow loss in the turbine blade.

(7) In some embodiments, in any one of the above configurations (1) to (6), the turbine blade is configured such that the concave portion on suction surface and the convex portion on pressure surface of an adjacent turbine blade form a smooth slope from the bottom point of the concave portion on suction surface to the peak point of the convex portion on pressure surface.

With the above configuration (7), since the concave portion on suction surface and the convex portion on pressure surface of the adjacent turbine blade form the smooth slope from the bottom point of the concave portion on suction surface to the peak point of the convex portion on pressure surface, it is possible to smoothly introduce the leakage flow avoiding the collision against the suction surface by the concave portion on suction surface to the vicinity of the convex portion on pressure surface. Thus, it is possible to effectively prevent the leakage flow from becoming the secondary flow in the vicinity of the pressure surface and to effectively reduce the secondary flow loss in the turbine blade.

(8) In some embodiments, in any one of the above configurations (1) to (7), the end wall further includes a convex portion on suction surface disposed at least in the region of suction surface, and the convex portion on suction surface expands along the suction surface over a range that includes a throat forming position located on the axially downstream side of the tangent point on the suction surface.

With the above configuration (8), since the above-described convex portion on suction surface is disposed in the end wall, it is possible to reduce the static pressure in the vicinity of the convex portion on suction surface, making it possible to make the contour line on the suction surface more parallel to the blade height direction in the range including the throat forming position in the vicinity of the end wall. Moreover, since the concave portion on suction surface has the obliquity ascending downstream from the bottom point along the suction surface, it is possible to make the contour line on the suction surface described above much more parallel to the blade height direction at an axial position of the concave portion on suction surface. Thus, it is possible to suppress curl-up of a secondary flow swirl that may be caused in the vicinity of the base-end portion of the airfoil portion, and to reduce the secondary flow loss more effectively.

(9) In some embodiments, in the above configuration (8), the convex portion on pressure surface and the convex portion on suction surface of an adjacent turbine blade share at least one contour line.

With the above configuration (9), since the convex portion on pressure surface and the convex portion on suction surface of the adjacent turbine blade share at least one contour, between the turbine blades adjacent to each other, the end wall has a shape formed by smoothly connecting the convex portion on pressure surface and the convex portion on suction surface. Thus, blocking of a fluid flow between the turbine blades is suppressed, making it possible to suppress a decrease in turbine efficiency.

(10) In some embodiments, in any one of the above configurations (1) to (9), a ratio L2/L0 of an axial distance L2 between the leading edge and a front end of the platform to an axial length L0 of the airfoil portion on the end wall is at most 0.1.

In accordance with, for example, the type of turbine, the turbine blade in which the ratio L2/L0 of the axial distance L2 between the leading edge of the airfoil portion and the front end of the platform to the axial length L0 of the airfoil portion on the end wall is at most 0.1 as in the above configuration (10), that is, a turbine blade having the relatively short axial distance L2 between the front end of the platform and the leading edge of the airfoil portion may be used. In this regard, with the above configuration (10), when the above-described turbine blade having the relatively short axial distance L2 between the front end of the platform and the leading edge of the airfoil portion is adopted, as described in the above configuration (1), it is possible to effectively reduce the loss which may be caused by the leakage flow in the turbine.

(11) In some embodiments, in any one of the above configurations (1) to (10), the base-end portion of the airfoil portion includes a fillet portion disposed in a connection portion to the platform, and an axial distance L2 between the leading edge and a front end of the platform is not less than 50% and not greater than 100% of a width of the fillet portion in a planar view.

With the above configuration (11), in accordance with, for example, the type of turbine, the turbine blade in which the axial distance L2 between the leading edge of the airfoil portion and the front end of the platform is not less than 50% and not greater than 100% of the width of the fillet portion disposed in the base-end portion of the airfoil portion as in the above configuration (11), that is, the turbine blade having the relatively short axial distance L2 between the front end of the platform and the leading edge of the airfoil portion may be used. In this regard, with the above configuration (11), when the above-described turbine blade having the relatively short axial distance L2 between the front end of the platform and the leading edge of the airfoil portion is adopted, as described in the above configuration (1), it is possible to effectively reduce the loss which may be caused by the leakage flow in the turbine.

(12) In some embodiments, in any one of the above configurations (1) to (11), the concave portion on suction surface extends without crossing a dividing line forming a boundary with an adjacent turbine blade.

With the above configuration (12), since the concave portion on suction surface extends without crossing the dividing line forming the boundary with the adjacent turbine blade and does not stride over the dividing line, productivity of the turbine blade is good.

(13) A steam turbine according to at least some embodiments of the present invention includes the turbine blade according to any one of the above configurations (1) to (12).

In the steam turbine, the leakage flow without the circumferential component may flow into the vicinity of the end wall of the turbine blade from the upstream side of the turbine blade. The leakage flow flows into the rotating turbine blade and then heads for the suction surface of the turbine blade, which may cause a collision (back hit) of the leakage flow against the suction surface, or due to an interaction between the leakage flow and a flow (main flow) including the circumferential component, may cause circumferential non-uniformity of a static pressure distribution.

In this regard, in the above configuration (13), the bottom point of the concave portion on suction surface is located on the axially upstream side of the above-described tangent point, and the above-described normal vector is directed toward the airfoil portion. That is, the bottom point of the concave portion on suction surface is located close to the suction surface on the axially upstream side of a position where the suction surface protrudes the most (a position of the above-described tangent point), and the concave portion on suction surface has an obliquity descending toward the suction surface in the vicinity of the suction surface. Thus, it is possible to increase the static pressure in the vicinity of the above-described position, making it possible to alleviate the circumferential non-uniformity of the static pressure distribution in the vicinity of the end wall in the axially upstream portion of the turbine blade, or to reduce the collision (back hit) of the leakage flow from the upstream side of the turbine blade against the suction surface. Thus, it is possible to reduce the circumferential non-uniformity of the static pressure distribution and a loss owing to the back hit of the leakage flow.

Moreover, in the above configuration (13), the peak point of the convex portion on pressure surface is located on the axially downstream side of the above-described tangent point. That is, the peak point of the convex portion on pressure surface is located on the axially downstream side of the bottom point of the concave portion on suction surface. Thus, it is possible to reduce the static pressure in the vicinity of the above-described position, making it possible to reduce a secondary flow from the pressure surface toward the suction surface of the adjacent turbine blade, and to prevent, for example, a leakage flow avoiding a collision against the suction surface by the above-described concave portion on suction surface from becoming the secondary flow in the vicinity of the pressure surface. Thus, it is possible to reduce a secondary flow loss in the turbine blade.

In view of the foregoing, with the above configuration (13), it is possible to effectively reduce the loss which may be caused by the leakage flow in the turbine.

(14) In some embodiments, in the above configuration (13), the steam turbine includes a rotor blade which is the turbine blade, and a stator vane disposed adjacent to the rotor blade on an upstream side of the rotor blade in an axial direction of the steam turbine, and a ratio L3/L0 of an axial width L3 of a cavity formed between the rotor blade and the stator vane to an axial length L0 of the airfoil portion on the end wall is at least 0.15.

In the steam turbine in which the ratio L3/L0 of the axial width L3 of the cavity to the axial length L0 of the airfoil portion is at least 0.15 as in the above configuration (14), that is, in the steam turbine including the relatively wide cavity, an influence by the leakage flow from the cavity may be prominent, and a collision of the above-described leakage flow against the suction surface and the circumferential non-uniformity of the static pressure distribution are likely to occur.

In this regard, with the above configuration (14), as described in the above configuration (13), it is possible to reduce the circumferential non-uniformity of the static pressure distribution and the loss owing to back hit of the leakage flow, or to reduce the secondary flow loss in the turbine blade. Thus, with the above configuration (13), it is possible to effectively reduce the loss which may be caused by the leakage flow in the turbine.

Advantageous Effects

An object of at least one embodiment of the present invention is to provide a turbine blade capable of reducing a loss which may be caused by a leakage flow, and a steam turbine including the same.

DETAILED DESCRIPTION

Figure 1:
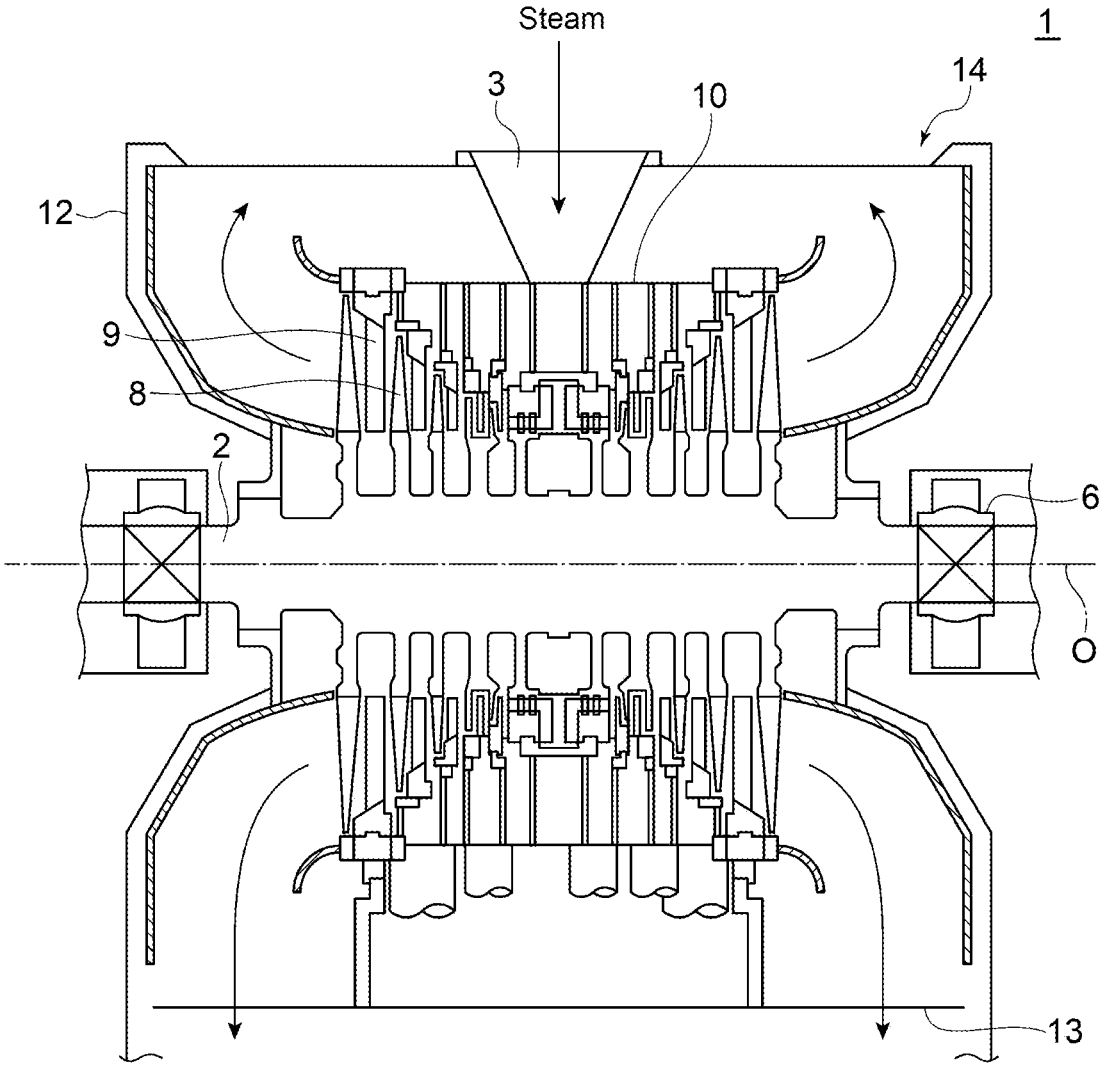
FIG. 1 is a schematic cross-sectional view of a steam turbine according to an embodiment, taken along its axial direction.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

First, the overall configuration of a steam turbine as an example of a turbine to which a turbine blade is applied according to some embodiments will be described with reference to FIGS. 1 and 2. The turbine in the present invention is not limited to the steam turbine, but may be, for example, a gas turbine.

FIG. 1 is a schematic cross-sectional view of the steam turbine according to an embodiment, taken along its axial direction. FIG. 2 is a schematic enlarged view including a stator vane and a rotor blade of the turbine according to an embodiment.

As shown in FIG. 1, a steam turbine 1 includes a rotor 2 rotatably supported by a bearing portion 6, a plurality of stages of rotor blades 8 and stator vanes 9, an inner casing 10, and an outer casing 12. The plurality of rotor blades 8 and a plurality of stator vanes 9 are arranged in the circumferential direction to form rows, respectively. The rows of the rotor blades 8 and the rows of the stator vanes 9 are arranged alternately in the axial direction.

Figure 2:
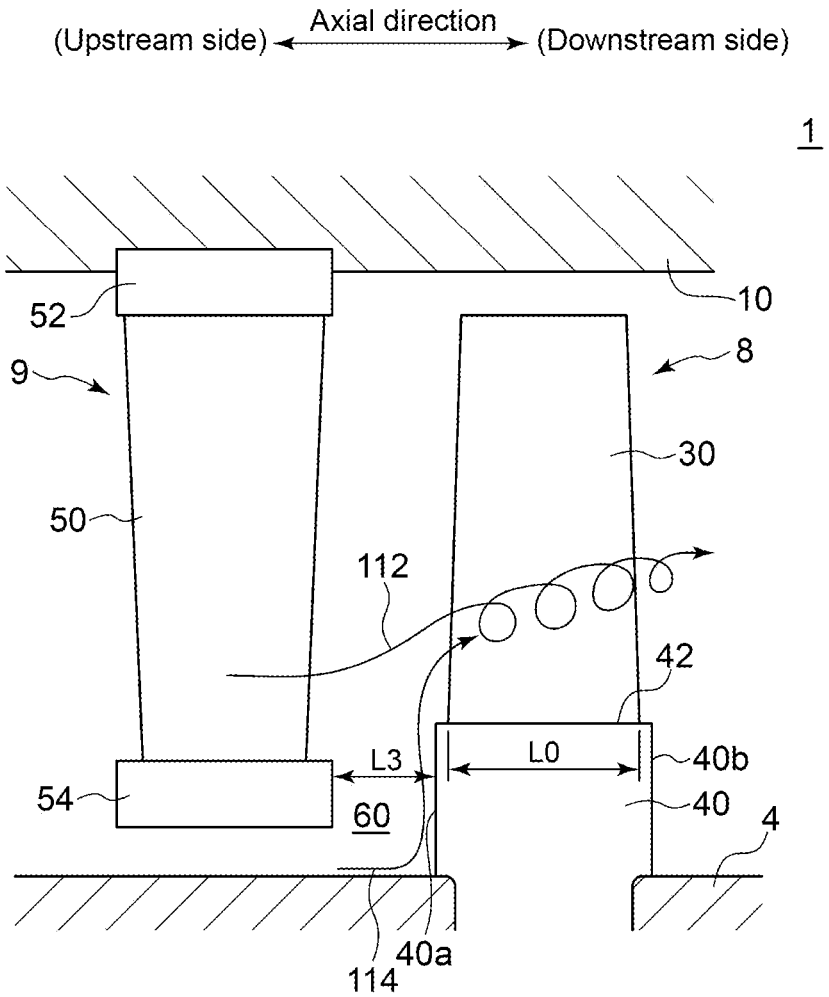
FIG. 2 is a schematic enlarged view including a stator vane and a rotor blade of the turbine according to an embodiment.

As shown in FIGS. 1 and 2, the rotor blade 8 includes an airfoil portion 30 and a platform 40 to which the airfoil portion 30 is connected, and is mounted to a rotor disc 4 of the rotor 2 via the platform 40. The rotor 2 and the rotor blade 8 are housed in the inner casing 10.

Moreover, the stator vane 9 includes an airfoil portion 50, and an outer ring 52 and an inner ring 54 disposed on the radially outer side and the radially inner side of the airfoil portion 50, respectively. The stator vane 9 is supported by the inner casing 10 via the outer ring 52 and the inner ring 54.

In such a steam turbine 1, if steam is introduced from a steam inlet 3 to the inner casing 10, the steam expands and increases in speed when passing through the stator vane 9, performs work on the rotor blades 8, and rotates the rotor 2.

In addition, the steam turbine 1 includes an exhaust hood 14. Steam (steam flows S) having passed through the rotor blades 8 and the stator vanes 9 in the inner casing 10 flows into the exhaust hood 14, and is discharged to the outside of the steam turbine 1 from an exhaust hood outlet 13 disposed on a lower side of the exhaust hood 14 through the inside of the exhaust hood 14.

A condenser (not shown) is disposed below the exhaust hood 14. The steam having finished working on the rotor blades 8 in the steam turbine 1 is discharged from the exhaust hood 14 via the exhaust hood outlet 13 and flows into the condenser.

The turbine blade according to some embodiments may be the rotor blade 8 of the steam turbine 1.

As an example of the turbine blade according to some embodiments, the rotor blade 8 of the steam turbine 1 described above will be described below in more detail.

Figure 3:
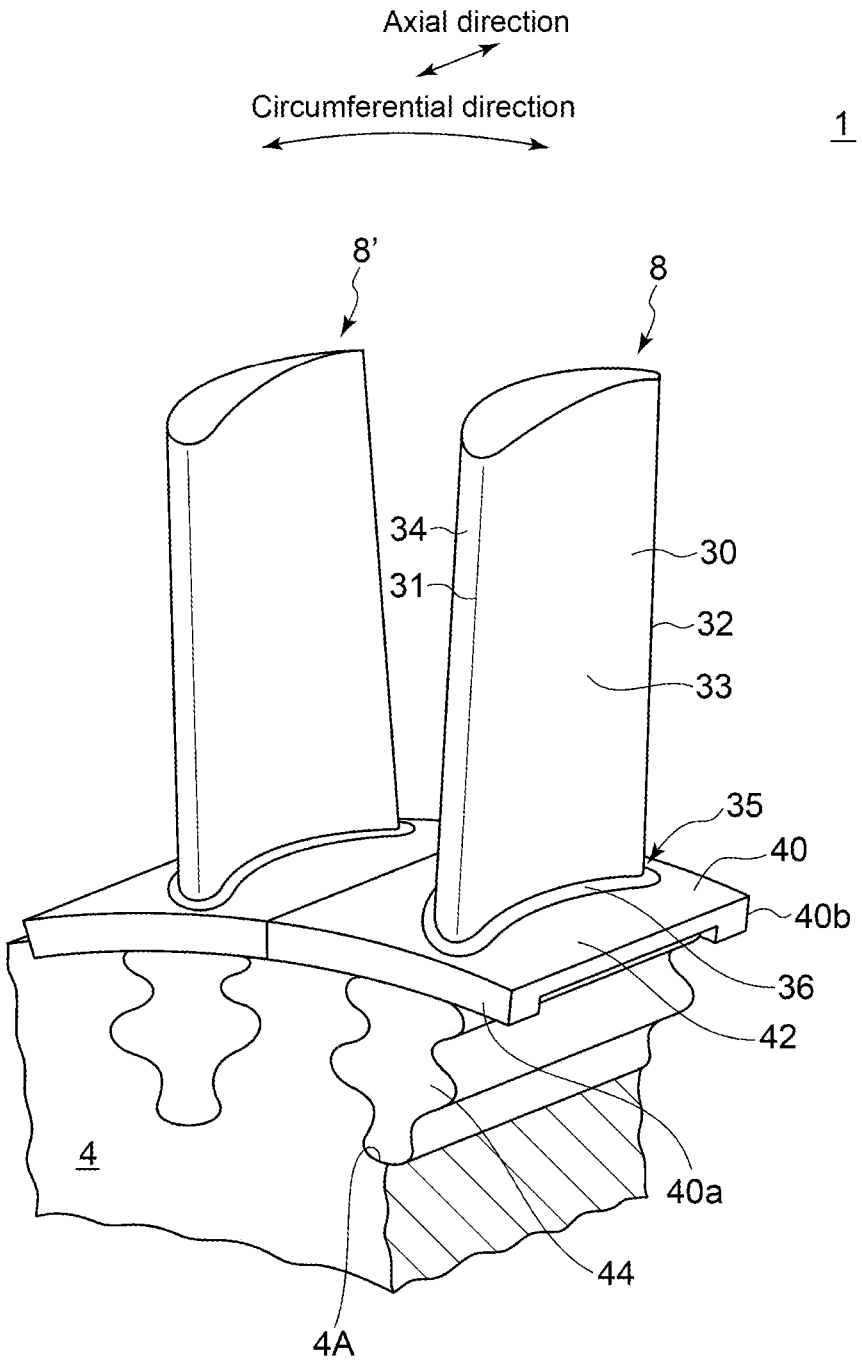
FIG. 3 is a schematic view of rotor blades installed on the steam turbine according to an embodiment.
Figure 4A:
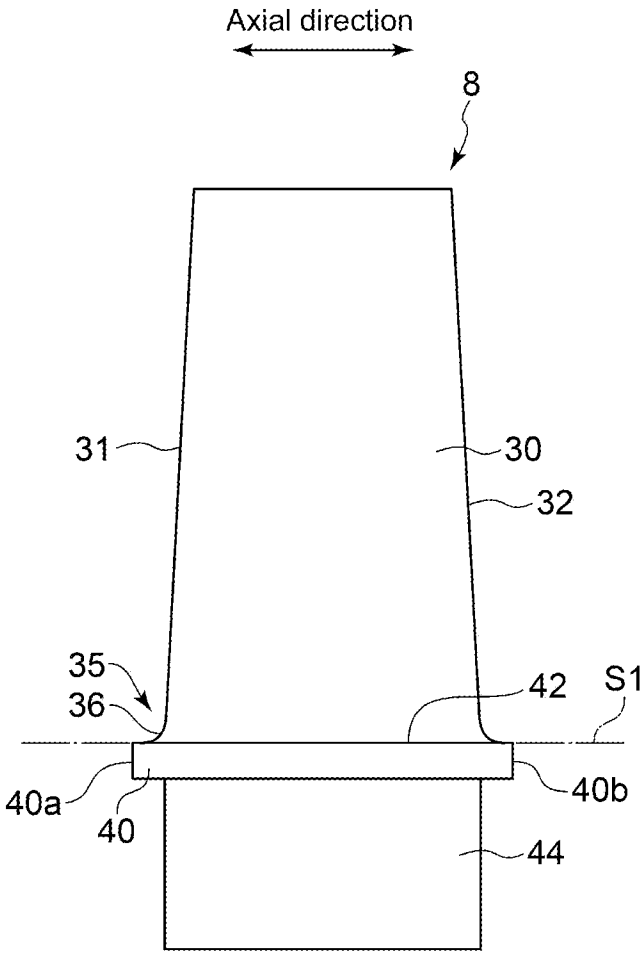
FIG. 4A is a schematic view of the rotor blade according to an embodiment.
Figure 4B:
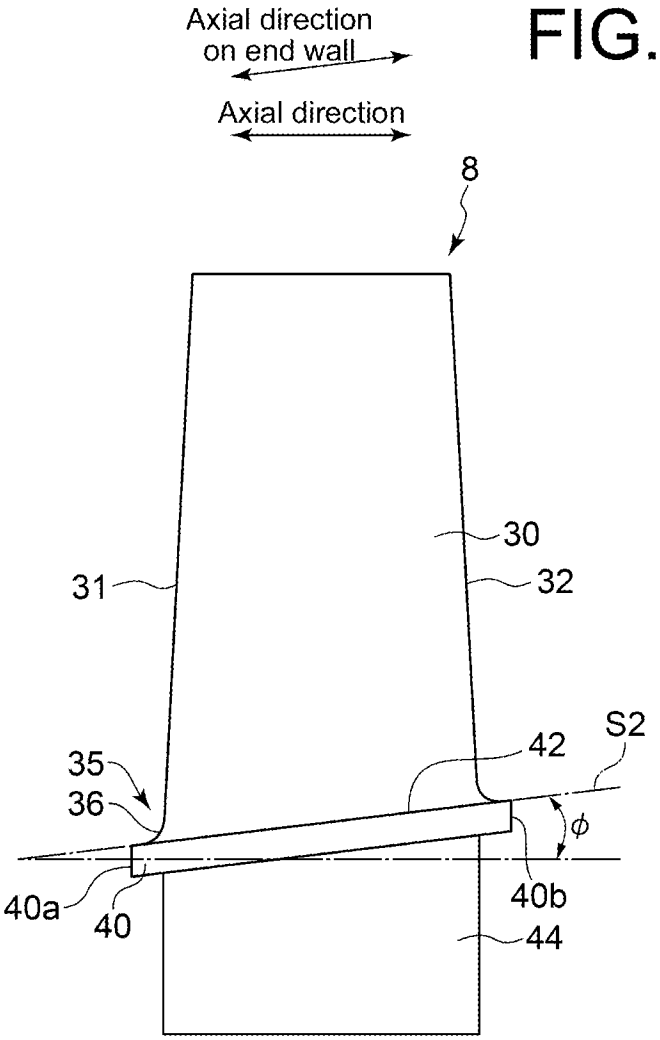
FIG. 4B is a schematic view of the rotor blade according to an embodiment.

FIG. 3 is a schematic view of rotor blades installed on the steam turbine 1 according to an embodiment. Each of FIGS. 4A and 4B is a schematic view of the rotor blade according to an embodiment. FIGS. 3 to 4B are views for describing the basic configuration of the turbine blade, and thus FIGS. 3 to 4B do not show a "concave portion on suction surface, a "convex portion on pressure surface", and the like to be described later.

As shown in FIGS. 3 and 4, the rotor blade 8 (turbine blade) includes the airfoil portion 30, the platform 40 to which the airfoil portion 30 is connected, and a blade root portion 44.

The airfoil portion 30 includes a leading edge 31 and a trailing edge 32 each of which extends along a blade height direction, and a pressure surface 33 and a suction surface 34 each of which extends between the leading edge 31 and the trailing edge 32. The airfoil portion 30 has a base-end portion 35 connected to an end wall 42 (side wall) of the platform 40. On a connection portion of the base-end portion 35 and the platform 40, a fillet portion 36 for relaxing a stress concentration in the connection portion is disposed.

The blade root portion 44 is connected to the platform 40 on an opposite side to the airfoil portion 30. As shown in FIG. 3, the blade root portion 44 engages with a groove 4A formed in the rotor disc 4, thereby mounting the rotor blade 8 to the rotor 2 (see FIG. 1).

As shown in FIG. 3, in the steam turbine 1, the plurality of rotor blades 8 are circumferentially arranged around a center axis, thereby forming an annular blade row. FIG. 3 shows a pair of adjacent rotor blades 8, 8' of the plurality of rotor blades 8 forming the annular blade row. The axial direction which is the direction of the center axis described above is a direction orthogonal to the above-described circumferential direction, and is the same direction as a center axis O (see FIG. 1) of the rotor 2 for the steam turbine 1.

In the airfoil portion 30 of the rotor blade 8, the leading edge 31 is located on the axially upstream side, and the trailing edge 32 is located on the axially downstream side. Moreover, the platform 40 has a front end 40*a* and a rear end 40*b*, and extends between the front end 40*a* and the rear end 40*b* in the axial direction. That is, the front end 40*a* of the platform 40 is an upstream end in the axial direction, and the rear end 40*b* of the platform 40 is a downstream end in the axial direction.

The platform 40 of the rotor blade 8 shown in FIG. 4A extends along the axial direction. In this case, the platform 40 of the plurality of rotor blades 8 arranged adjacent to each other in the circumferential direction has a shape of a columnar side surface. A surface S1 forming the columnar side surface will be referred to as a reference surface of the end wall 42 of the rotor blade 8 shown in FIG. 4A.

On the other hand, the platform 40 of the rotor blade 8 shown in FIG. 4B extends obliquely with respect to the axial direction. In this case, the platform 40 of the plurality of rotor blades 8 arranged adjacent to each other in the circumferential direction has a shape of a conical side surface. The platform 40 in FIG. 4B is oblique with respect to the axial direction by an angle φ. A surface S2 forming the conical side surface will be referred to as a reference surface of the end wall 42 of the rotor blade 8 shown in FIG. 4B.

The characteristics of the end wall 42 of the rotor blade 8 according to some embodiments will be described below. The end wall 42 will be described below with reference to a state in which the end wall 42 is viewed from a direction orthogonal to the above-described reference surfaces S1, S2 toward the center axis. For example, an axial straight line on the end wall 42 means the axial straight line perpendicularly projected on the end wall 42 (see the "axial direction on the end wall" in FIG. 4B).

Figure 5:
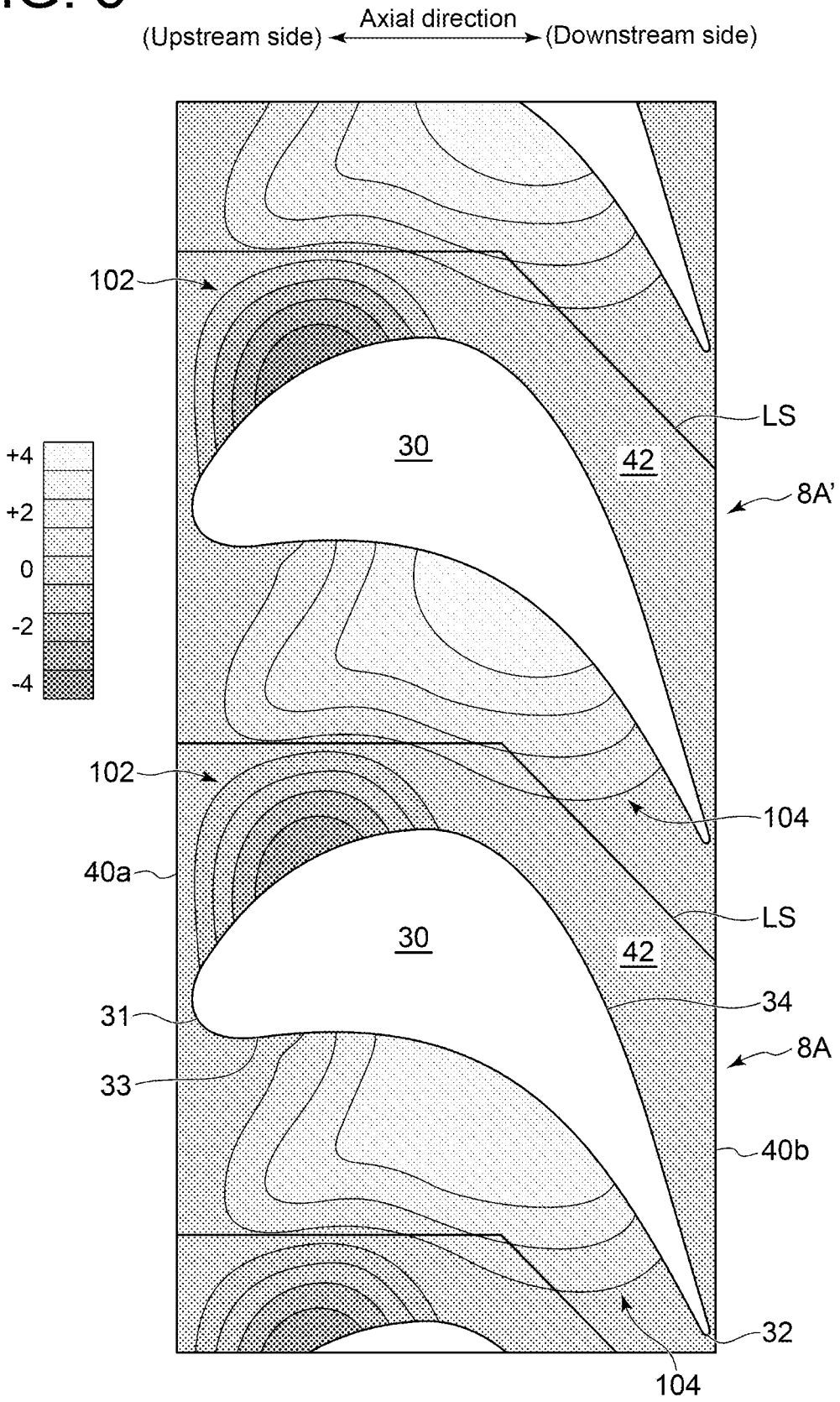
FIG. 5 is a contour map of an end wall of rotor blades according to an embodiment.
Figure 6:
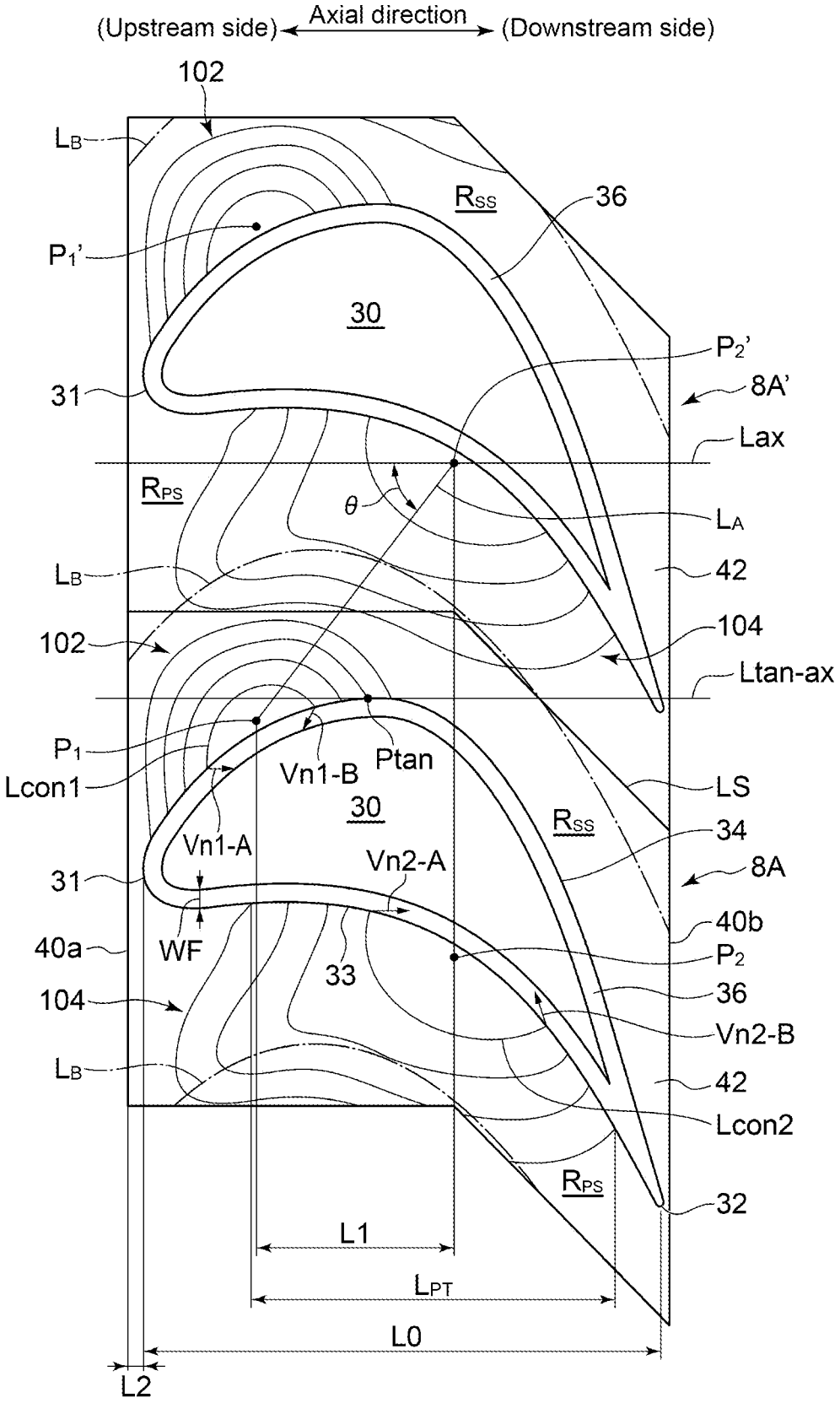
FIG. 6 is a contour map of the end wall of the rotor blades according to an embodiment.

Each of FIGS. 5 and 6 is a contour map of the end wall 42 of a rotor blade 8A (rotor blade 8) according to an embodiment. FIG. 5 shows heights of the end wall 42 at respective positions by a plurality of contour lines and a shade of color. The above-described reference surface (S1 of FIG. 4A or S2 of FIG. 4B) is a surface of zero height. FIG. 6 shows the same contour map as FIG. 5 without the shade of color.

The contour lines in the present specification are contour lines on the end wall 42 including the region of pressure surface and the region of suction surface to be described later, and do not include a contour line of the airfoil portion 30 (including the fillet portion 36).

As shown in FIGS. 5 and 6, the end wall 42 of the rotor blade 8A includes a concave portion on suction surface 102 disposed at least in a region of suction surface $R_{SS}$ of the end wall 42 and a convex portion on pressure surface 104 disposed at least in a region of pressure surface $R_{PS}$ of the end wall 42. The end wall 42 is divided into the region of suction surface $R_{SS}$ and the region of pressure surface $R_{PS}$ by a region boundary line $L_B$. The region boundary line $L_B$ is a line that connects center positions of the suction surface 34 of the rotor blade 8A and a pressure surface of the adjacent rotor blade. The region of suction surface $R_{SS}$ is a region between the suction surface 34 and the region boundary line $L_B$, and the region of pressure surface $R_{PS}$ is a region between the pressure surface 33 and the region boundary line $L_B$. In FIGS. 5 and 6, on the side of the suction surface 34 of the rotor blade 8A, a rotor blade 8A' is disposed adjacent to the rotor blade 8A.

In some embodiments, a part of the concave portion on suction surface 102 may exist on the region of pressure surface $R_{PS}$, or a part of the convex portion on pressure surface 104 may exist on the region of suction surface $R_{SS}$.

A bottom point P1, which is a point of a lowest height in the concave portion on suction surface 102, is located on the axially upstream side of a tangent point Ptan on the suction surface 34 which has a tangential line Ltan-ax extending in the axial direction through the tangent point Ptan. Then, the end wall 42 has a contour line Lcon1 on the concave portion on suction surface 102. The contour line Lcon1 has a shape such that a normal vector Vn1-A, Vn1-B, which has a negative gradient along a normal line of the contour line Lcon1 on an intersection point between the contour line Lcon1 and the suction surface 34, is directed toward the airfoil portion 30.

Moreover, a peak point P2, which is a point of a highest height in the convex portion on pressure surface 104, is located on the axially downstream side of the above-described tangent point Ptan. Provided that an axial position of the leading edge 31 is 0% Cax, and an axial position of the trailing edge is 100% Cax, an axial position of the peak point P2 may be not less than 50% Cax and not greater than 80% Cax.

A leakage flow 112 without a circumferential component from the upstream side of the rotor blade 8 may flow into the vicinity of the end wall 42 of the rotor blade 8 (turbine blade). For example, in the steam turbine 1 shown in FIG. 2, in addition to inflow of the main flow 112 which is rectified by the stator vane 9 disposed on the upstream side of the rotor blade 8, includes the circumferential component, and heads for the pressure surface 33 of the rotor blade 8, a leakage flow 114 without the circumferential component from a cavity 60 between the rotor blade 8 and the stator vane 9 may flow into the rotor blade 8. Since the rotor blade 8 (turbine blade) rotates, the leakage flow 114 without the circumferential component heads for the suction surface 34 of the rotor blade 8. Thus, a collision (back hit) of the leakage flow 114 against the suction surface 34 may be caused, or due to an interaction between the leakage flow 114 and the main flow 112 including the circumferential component having passed through the stator vane 9, circumferential non-uniformity of a static pressure distribution may be caused in the vicinity of the front end 40*a* of the platform 40 of the rotor blade 8.

In this regard, in the above-described rotor blade 8A, the bottom point P1 of the concave portion on suction surface 102 is located on the axially upstream side of the above-described tangent point Ptan, and the above-described normal vector Vn1-A, Vn1-B is directed toward the airfoil portion 30. That is, the bottom point P1 of the concave portion on suction surface 102 is located close to the suction surface 34 on the axially upstream side of a position where the suction surface 34 protrudes the most (a position of the above-described tangent point Ptan), and the concave portion on suction surface 102 has an obliquity descending toward the suction surface 34 in the vicinity of the suction surface 34. Thus, it is possible to increase the static pressure in the vicinity of the above-described position, making it possible to alleviate the circumferential non-uniformity of the static pressure distribution in the vicinity of the end wall 42 in the axially upstream portion of the rotor blade 8A, or to reduce the collision (back hit) of the leakage flow from the upstream side of the rotor blade 8A against the suction surface 34. Thus, it is possible to reduce the circumferential non-uniformity of the static pressure distribution and a loss owing to the back hit of the leakage flow.

Moreover, in the above-described rotor blade 8A, the peak point P2 of the convex portion on pressure surface 104 is located on the axially downstream side of the above-described tangent point Ptan. That is, the peak point P2 of the convex portion on pressure surface 104 is located on the axially downstream side of the bottom point P1 of the concave portion on suction surface 102. Thus, it is possible to reduce the static pressure in the vicinity of the above-described position, making it possible to reduce a secondary flow from the pressure surface 33 toward the suction surface 34 of the adjacent rotor blade 8A, and to prevent, for example, a leakage flow avoiding a collision against the suction surface 34 by the above-described concave portion on suction surface 102 from becoming the secondary flow in the vicinity of the pressure surface 33. Thus, it is possible to reduce a secondary flow loss in the rotor blade 8A.

In view of the foregoing, with the above-described rotor blade 8A, it is possible to effectively reduce the loss which may be caused by the leakage flow in the steam turbine 1.

In some embodiments, for example, as shown in FIGS. 5 and 6, a contour line Lcon2 of the convex portion on pressure surface 104 has a shape such that a normal vector Vn2-A, which has a positive gradient along a normal line of the contour line Lcon2 on an intersection point between the contour line Lcon2 and the pressure surface 33, is directed toward the airfoil portion 30.

In this case, the above-described normal vector Vn2-A is directed toward the airfoil portion 30, that is, the peak point P2 of the convex portion on pressure surface 104 is located close to the pressure surface 33, and the convex portion on pressure surface 104 has an obliquity ascending toward the pressure surface 33 in the vicinity of the pressure surface 33. Thus, it is possible to reduce the static pressure in the vicinity of the above-described position, making to possible to effectively reduce the secondary flow in the rotor blade 8A (turbine blade) and to reduce the loss by the secondary flow more effectively.

In some embodiments, for example, as shown in FIGS. 5 and 6, the convex portion on pressure surface 104 expands along the pressure surface 33 at least from a position of the peak point P2 to a position of the bottom point P1 of the concave portion on suction surface 102 in the axial direction.

For example, the convex portion on pressure surface 104 may extend along the pressure surface 33 over not less than 90% of an axial length (that is, an axial distance between a position of the leading edge 31 and a position of the trailing edge 32) L0 of the airfoil portion 30 on the end wall 42. In other words, an axial length $L_{PT}$ of the convex portion on pressure surface 104 in an extension range along the pressure surface 33 may be not less than 90% of the axial length L0 of the airfoil portion 30 described above.

In this case, since the convex portion on pressure surface 104 extends along the pressure surface 33 over a wide range at least from the position of the peak point P2 of the convex portion on pressure surface 104 to the position of the bottom point P1 of the concave portion on suction surface 102 in the axial direction, it is possible to reduce the static pressure over the wide range in the vicinity of the pressure surface 33. Thus, it is possible to effectively prevent the leakage flow avoiding the collision against the suction surface 34 by the concave portion on suction surface 102 of the rotor blade 8A from becoming the secondary flow in the vicinity of the pressure surface 33 of the adjacent rotor blade 8A. Thus, it is possible to effectively reduce the secondary flow loss in the rotor blade 8A.

In some embodiments, a ratio L1/L0 of an axial distance L1 (see FIG. 6) between the bottom point P1 of the concave portion on suction surface 102 and the peak point P2 of the convex portion on pressure surface 104 of the rotor blade 8A to the axial length L0 (see FIG. 6) of the airfoil portion 30 on the end wall 42 may be at least 0.1 and at most 0.9.

In this case, since the ratio L1/L0 of the distance L1 between the bottom point of the concave portion on suction surface and the peak point of the convex portion on pressure surface to the axial length L0 of the airfoil portion 30 on the end wall 42 is at least 0.1 and at most 0.9, the leakage flow avoiding the collision against the suction surface 34 by the concave portion on suction surface 102 is easily introduced to the vicinity of the convex portion on pressure surface 104 of the adjacent rotor blade 8A. Thus, it is possible to effectively prevent the leakage flow from becoming the secondary flow in the vicinity of the pressure surface 33 of the adjacent rotor blade 8A and to effectively reduce the secondary flow loss in the rotor blade 8A.

Alternatively, in some embodiments, an angle θ (see FIG. 6) between an axial straight line Lax, and a straight line LA that connects the bottom point P1 of the concave portion on suction surface 102 of the rotor blade 8A and a peak point P1' of the convex portion on pressure surface 104 of the adjacent turbine blade 8A' is not less than 10 degrees and not greater than 80 degrees.

In this case, since the angle between the axial straight line Lax, and the straight line LA that connects the bottom point P1 of the concave portion on suction surface 102 and a peak point P2' of the convex portion on pressure surface 104 of the adjacent turbine blade 8A' is not less than 10 degrees and not greater than 80 degrees, the leakage flow avoiding the collision against the suction surface 34 by the concave portion on suction surface 102 is easily introduced to the vicinity of the convex portion on pressure surface 104 of the adjacent rotor blade 8A'. Thus, it is possible to effectively prevent the leakage flow from becoming the secondary flow in the vicinity of the pressure surface 33 and to effectively reduce the secondary flow loss in the rotor blade 8A.

In some embodiments, for example, as shown in FIGS. 5 and 6, the turbine blade is configured such that the concave portion on suction surface 102 of the rotor blade 8A and the convex portion on pressure surface 104 of the adjacent rotor blade 8A' form a smooth slope from the bottom point P1 of the concave portion on suction surface 102 to the peak point P2' of the convex portion on pressure surface 104. That is, in the embodiments shown in FIGS. 5 and 6, the height of the end wall 42 monotonically increases from the bottom point P1 of the concave portion on suction surface 102 of the rotor blade 8A to the peak point P2' of the convex portion on pressure surface 104 of the adjacent rotor blade 8A'.

In this case, since the concave portion on suction surface 102 of the rotor blade 8A and the convex portion on pressure surface 104 of the adjacent rotor blade 8A' form the smooth slope from the bottom point P1 of the concave portion on suction surface 102 to the peak point P2' of the convex portion on pressure surface 104, the leakage flow avoiding the collision against the suction surface 34 by the concave portion on suction surface 102 can smoothly be introduced to the vicinity of the convex portion on pressure surface 104 of the adjacent rotor blade 8A'. Thus, it is possible to effectively prevent the leakage flow from becoming the secondary flow in the vicinity of the pressure surface 33 of the adjacent rotor blade 8A' and to effectively reduce the secondary flow loss in the rotor blade 8A.

In some embodiments, a ratio L2/L0 of an axial distance L2 (see FIG. 6) between the front end 40*a* of the platform 40 and the leading edge 31 of the airfoil portion 30 in the end wall 42 to the axial length L0 of the airfoil portion 30 on the end wall 42 may be at most 0.1.

Alternatively, in some embodiments, the above-described distance L2 is not less than 50% and not greater than 100% of a width $W_F$ (see FIG. 6) of the fillet portion 36 disposed on the base-end portion 35 of the airfoil portion 30 in a planar view (that is, the width of the fillet portion 36 as the end wall 42 is viewed from a direction orthogonal to the above-described reference surface S1 or S2).

For uniformity of the circumferential distribution of the static pressure in the vicinity of the front end 40*a* of the platform 40, it is desirable that the above-described concave portion on suction surface 102 is disposed close to the front end 40*a* as much as possible.

Meanwhile, in accordance with, for example, the type of turbine, a turbine blade having the relatively short axial distance L2 between the front end 40*a* of the platform 40 and the leading edge 31 of the airfoil portion 30 may be used, as described above. The above-described turbine blade is used in a case in which, for example, a rotor length is requested to be short as much as possible in terms of measures against a vibration in the turbine. In this case, it is difficult to dispose the concave portion on suction surface on the upstream side of the leading edge 31 of the airfoil portion 30, due to limitations of space.

In this regard, with the rotor blade 8A according to the above-described embodiment, as already described, it is possible to effectively reduce the loss which may be caused by the leakage flow in the turbine, even if the axial distance L2 between the front end 40*a* of the platform 40 and the leading edge 31 of the airfoil portion 30 is relatively short.

In some embodiments, for example, as shown in FIGS. 5 and 6, the concave portion on suction surface 102 of the rotor blade 8A extends without crossing a dividing line LS forming a boundary with an adjacent rotor blade 8A'.

Thus, since the concave portion on suction surface 102 of the rotor blade 8A extends without crossing the dividing line LS forming the boundary with an adjacent rotor blade 8A', that is, the concave portion on suction surface 102 does not stride over the dividing line LS, productivity of the rotor blade 8A is good.

Figure 7:
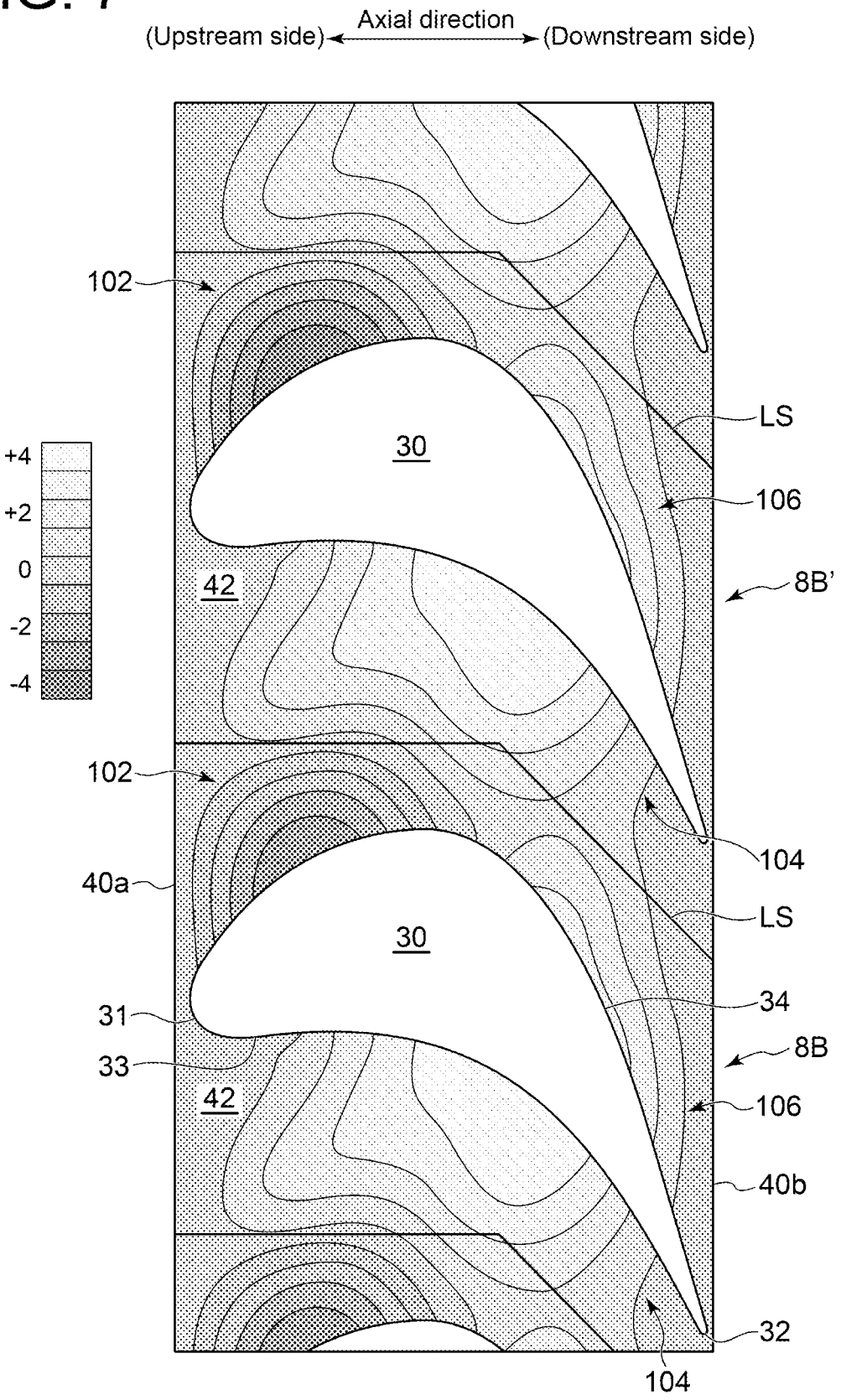
FIG. 7 is a contour map of the end wall of rotor blades according to an embodiment.
Figure 8:
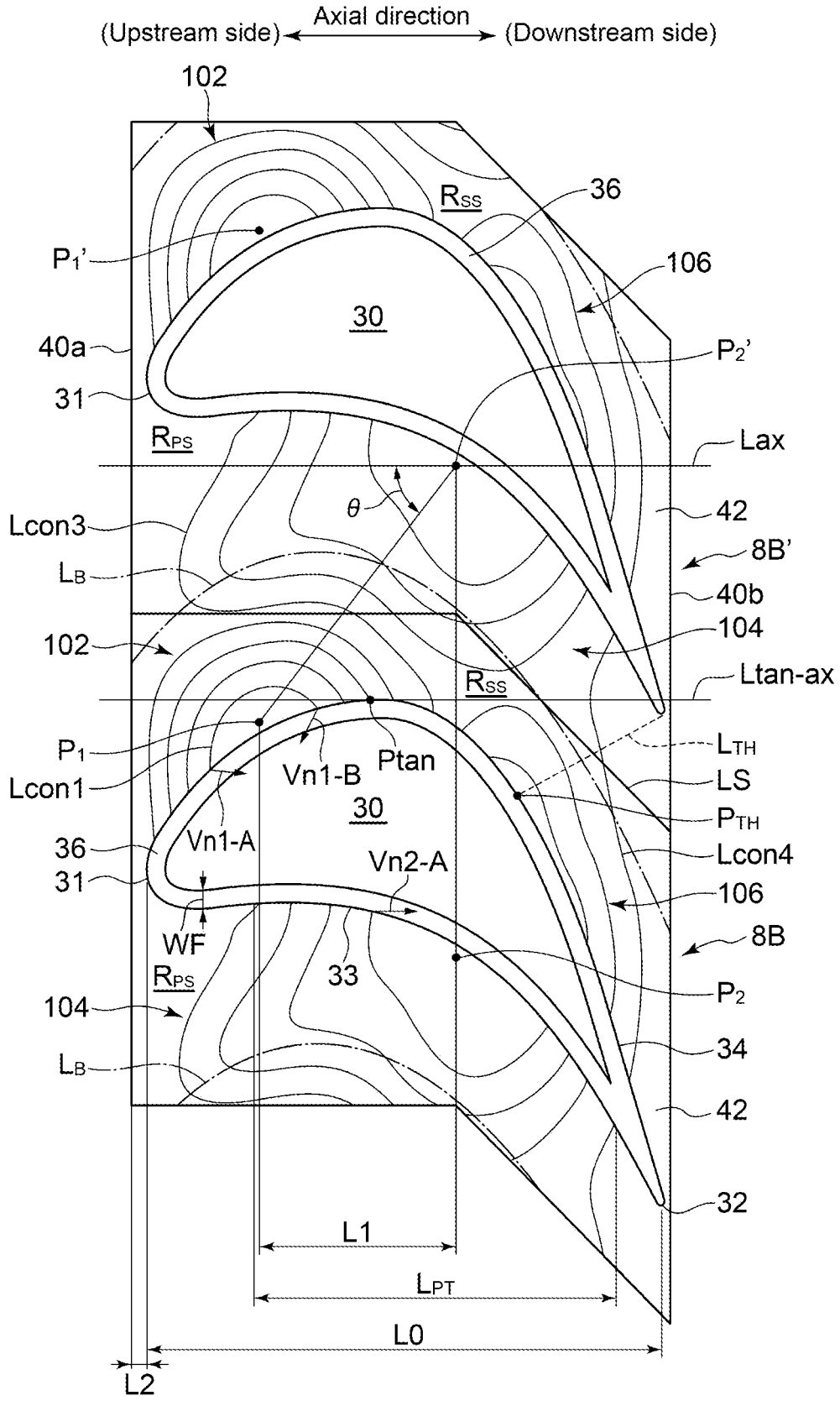
FIG. 8 is a contour map of the end wall of the rotor blades according to an embodiment.

Each of FIGS. 7 and 8 is a contour map of the end wall 42 of a rotor blade 8B (rotor blade 8) according to an embodiment different from the embodiments shown in FIGS. 5 and 6. FIG. 7 shows heights of the end wall 42 at respective positions by a plurality of contour lines and a shade of color. The above-described reference surface (S1 of FIG. 4A or S2 of FIG. 4B) is the surface of zero height. FIG. 8 shows the same contour map as FIG. 7 without the shade of color.

The rotor blade 8B according to the present embodiment has the characteristics of the rotor blade 8A that have already been described with reference to FIGS. 5 and 6. That is, the end wall 42 of the rotor blade 8B shown in FIGS. 7 and 8 includes the concave portion on suction surface 102 and the convex portion on pressure surface 104 each having the above-described characteristics.

The end wall 42 of the rotor blade 8B shown in FIGS. 7 and 8 further includes a convex portion on suction surface 106 disposed at least in the region of suction surface $R_{SS}$. Then, the convex portion on suction surface 106 expands along the suction surface 34 over a range that includes a throat forming position $P_{TH}$ located on the downward side of the tangent point Ptan on the suction surface 34.

The convex portion on suction surface 106 may partially extend to a region other than the region of suction surface $R_{SS}$.

In general, a fluid flows in a direction orthogonal to a contour line. However, in the case of the turbine blade without the convex portion on suction surface 106 described above, an obliquity of the contour line with respect to the blade height direction (spanwise direction) increases on a base-end side of the suction surface 34 (in the vicinity of the end wall 42) in particular, which may curl up a secondary flow swirl in the vicinity of the suction surface and increase a loss.

In this regard, in the embodiments shown in FIGS. 7 and 8, respectively, since the above-described convex portion on suction surface 106 is disposed in the end wall 42, it is possible to reduce the static pressure in the vicinity of the convex portion on suction surface 106, making it possible to make the contour line on the suction surface 34 more parallel to the blade height direction in the range including the throat forming position $P_{TH}$ in the vicinity of the end wall 42. Moreover, since the concave portion on suction surface 102 has the obliquity ascending downstream from the bottom point P1 along the suction surface 34, it is possible to make the contour line on the suction surface 34 described above much more parallel to the blade height direction at an axial position of the concave portion on suction surface 102. Thus, it is possible to suppress the curl-up of the secondary flow swirl that may be caused in the vicinity of the base-end portion 35 of the airfoil portion 30, and to reduce the secondary flow loss more effectively.

In some embodiments, for example, as shown in FIGS. 7 and 8, the convex portion on pressure surface 104 of a rotor blade 8B' and the convex portion on suction surface 106 of the adjacent rotor blade 8B share at least one contour line (a contour line Lcon3, Lcon4 in FIG. 8). That is, the convex portion on pressure surface 104 of the rotor blade 8B' and the convex portion on suction surface 106 of the adjacent rotor blade 8B form one continuous ridge.

In this case, since the convex portion on pressure surface 104 of the rotor blade 8B' and the convex portion on suction surface 106 of the adjacent rotor blade 8B share at least one contour line (Lcon3, Lcon4), between the rotor blades 8B adjacent to each other, the end wall 42 has a shape formed by smoothly connecting the convex portion on pressure surface 104 and the convex portion on suction surface 106. Thus, blocking of a fluid flow between the rotor blades 8B and 8B' is suppressed, making it possible to suppress a decrease in turbine efficiency.

In some embodiments, in the steam turbine 1, a ratio L3/L0 of an axial width L3 (see FIG. 2) of the cavity 60 formed between the rotor blade 8 and the stator vane 9 disposed on the axially upstream side of the rotor blade 8 to the axial length L0 (see FIG. 2, 6) of the airfoil portion 30 on the end wall 42 is at least 0.15.

As described above, the ratio L3/L0 of the axial width L3 of the cavity 60 to the axial length L0 of the airfoil portion 30 is at least 0.15, that is, in the steam turbine 1 including the relatively wide cavity 60, an influence by the leakage flow 114 from the cavity 60 may be prominent, and a collision of the above-described leakage flow against the suction surface 34 and the circumferential non-uniformity of the static pressure distribution are likely to occur.

In this regard, according to the above-described embodiment, as already described, it is possible to reduce the circumferential non-uniformity of the static pressure distribution and the loss owing to back hit of the leakage flow, or to reduce the secondary flow loss in the rotor blade 8, even under the above-described circumference where the loss owing to the leakage flow 114 is likely to occur. Thus, it is possible to effectively reduce the loss which may be caused by the leakage flow in the steam turbine 1.

Embodiments of the present invention were described in detail above, but the present invention is not limited thereto, and also includes an embodiment obtained by modifying the above-described embodiments and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "including" or "having" one constitutional element is not an exclusive expression that excludes the presence of other constitutional elements.

REFERENCE SIGNS LIST

1 Steam turbine
2 Rotor
3 Steam inlet
4 Rotor disc
4A Groove
6 Bearing portion
8, 8A, 8B Rotor blade
9 Stator vane
10 Inner casing
12 Outer casing
13 Exhaust hood outlet
14 Exhaust hood
30 Airfoil portion
31 Leading edge
32 Trailing edge
33 Pressure surface
34 Suction surface
35 Base-end portion
36 Fillet portion
40 Platform
40*a* Front end
40*b* Rear end
42 End wall
44 Blade root portion
50 Airfoil portion
52 Outer ring
54 Inner ring
60 Cavity
102 Concave portion on suction surface
104 Convex portion on pressure surface
106 Convex portion on suction surface
112 Main flow
$L_B$ Region boundary line
LS Dividing line
Lcon1 to Lcon4 Contour line
Ltan-ax Tangent line
O Center axis
P1 Bottom point
P2 Peak point
$P_{TH}$ Throat forming position
Ptan Tangent point
$R_{PS}$ Region of pressure surface
$R_{SS}$ Region of suction surface
S1 Reference surface
S2 Reference surface
Vn Normal vector

The invention claimed is:

1. A turbine blade, comprising:

an airfoil portion having a pressure surface and a suction surface each of which extends between a leading edge and a trailing edge; and a platform including an end wall to which a base-end portion of the airfoil portion is connected, wherein the end wall includes:

a concave portion on suction surface disposed at least in a region of suction surface of the end wall; and a convex portion on pressure surface disposed at least in a region of pressure surface of the end wall, wherein the concave portion on suction surface has a bottom point located on an axially upstream side of a tangent point on the suction surface, the suction surface having a tangential line extending in an axial direction through the tangent point, wherein the end wall has at least one contour line on the concave portion on suction surface, the at least one contour line having a normal line on an intersection point between the at least one contour line and the suction surface such that a normal vector having a negative gradient along the normal line is directed toward the airfoil portion, and wherein the convex portion on pressure surface has a peak point located on an axially downstream side of the tangent point.

2. The turbine blade according to claim 1, wherein the convex portion on pressure surface has at least one contour line having a normal line on an intersection point between the at least one contour line and the pressure surface such that a normal vector having a positive gradient along the normal line is directed toward the airfoil portion.

3. The turbine blade according to claim 1, wherein the convex portion on pressure surface expands along the pressure surface at least from a position of the peak point to a position of the bottom point of the concave portion on suction surface in the axial direction.

4. The turbine blade according to claim 1, wherein a ratio L1/L0 of an axial distance L1 between the bottom point of the concave portion on suction surface and the peak point of the convex portion on pressure surface to an axial length L0 of the airfoil portion on the end wall is at least 0.1 and at most 0.9.

5. The turbine blade according to claim 1, wherein an angle between an axial straight line, and a straight line that connects the bottom point of the concave portion on suction surface and the peak point of the convex portion on pressure surface of an adjacent turbine blade is not less than 10 degrees and not greater than 80 degrees.

6. The turbine blade according to claim 1, wherein the convex portion on pressure surface extends along the pressure surface over not less than 90% of an axial length L0 of the airfoil portion on the end wall.

7. The turbine blade according to claim 1, wherein the turbine blade is configured such that the concave portion on suction surface and the convex portion on pressure surface of an adjacent turbine blade form a smooth slope from the bottom point of the concave portion on suction surface to the peak point of the convex portion on pressure surface.

8. The turbine blade according to claim 1, wherein the end wall further includes a convex portion on suction surface disposed at least in the region of suction surface, and wherein the convex portion on suction surface expands along the suction surface over a range that includes a throat forming position located on the axially downstream side of the tangent point on the suction surface.

9. The turbine blade according to claim 8, wherein the convex portion on pressure surface and the convex portion on suction surface of an adjacent turbine blade share at least one contour line.

10. The turbine blade according to claim 1, wherein a ratio L2/L0 of an axial distance L2 between the leading edge and a front end of the platform to an axial length L0 of the airfoil portion on the end wall is at most 0.1.

11. The turbine blade according to claim 1, wherein the base-end portion of the airfoil portion includes a fillet portion disposed in a connection portion to the platform, and wherein an axial distance L2 between the leading edge and a front end of the platform is not less than 50% and not greater than 100% of a width of the fillet portion in a planar view.

12. The turbine blade according to claim 1, wherein the concave portion on suction surface extends without crossing a dividing line forming a boundary with an adjacent turbine blade.

13. A steam turbine, comprising:

the turbine blade according to claim 1.

14. The steam turbine according to claim 13, comprising:

a rotor blade which is the turbine blade; and a stator vane disposed adjacent to the rotor blade on an upstream side of the rotor blade in an axial direction of the steam turbine, wherein a ratio L3/L0 of an axial width L3 of a cavity formed between the rotor blade and the stator vane to an axial length L0 of the airfoil portion on the end wall is at least 0.15.

* * * * *